US005766092A

United States Patent [19]

Mimeur et al.

[11] Patent Number: 5,766,092

[45] Date of Patent: Jun. 16, 1998

[54] "IRON"-TYPE GOLF CLUB HEAD

[75] Inventors: Nicolas Mimeur, Annecy le Vieux; Jean-Marc Guibaud, Annecy, both of France

[73] Assignee: Taylor Made Golf Company, Carlsbad, Calif.

[21] Appl. No.: 226,467

[22] Filed: Apr. 12, 1994

[30] Foreign Application Priority Data

Apr. 16, 1993 [FR] France ..... 93 04653

[51] Int. Cl.[6] ..... A63B 53/04

[52] U.S. Cl. ..... 473/329; 473/332; 473/345; 473/350

[58] Field of Search ..... 273/167 R, 77 R, 273/167 H, 167 J, DIG. 8, 78, DIG. 23, 169, 171, 172, 173; 473/287–292, 324–350

[56] References Cited

U.S. PATENT DOCUMENTS

| | | | |
|---|---|---|---|
| 4,326,716 | 4/1982 | Lacoste | 273/167 R |
| 4,523,759 | 6/1985 | Igarashi | 273/169 |
| 4,635,941 | 1/1987 | Yoneyama | 273/167 J |
| 4,754,975 | 7/1988 | Aizawa | 273/169 |
| 4,762,322 | 8/1988 | Molitor | 273/169 |
| 4,928,972 | 5/1990 | Nakanishi . | |
| 4,936,582 | 6/1990 | Bernstein | 273/DIG. 8 |
| 5,106,094 | 4/1992 | Desbiolles | 273/167 H |
| 5,290,036 | 3/1994 | Fenton | 273/167 H |
| 5,316,298 | 5/1994 | Hutin | 276/167 H |

FOREIGN PATENT DOCUMENTS

| | | | |
|---|---|---|---|
| 481 677 | 4/1992 | European Pat. Off. . | |
| 2 680 695 | 3/1993 | France . | |
| 2238251 | 5/1991 | United Kingdom | 273/169 |
| 92/22356 | 12/1992 | WIPO . | |

*Primary Examiner*—Sebastiano Passaniti

*Attorney, Agent, or Firm*—Law Offices Pollock, Vande Sande & Priddy

[57] ABSTRACT

An iron-type golf club head comprising a hollow metal body (1) incorporating an internal cavity (2) delimited by a series of walls (10, 11, 12, 13) including an impact wall (10) connected peripherally at all points to other walls (11, 12, 13). The inner surface (100) of the impact wall (10) is coated with a thin layer (4) of a viscoelastic resin which has damping properties, and which fills only a portion of the internal cavity (2). The resin layer assures reduced interference vibrations peculiar to "hollow" irons, i.e., those incorporating an internal cavity for improved weight distribution.

7 Claims, 5 Drawing Sheets

"IRON"-TYPE GOLF CLUB HEAD

FIELD OF THE INVENTION

The present invention relates to an "iron"-type golf club head, as well as club fitted with such a head.

More specifically, the invention relates to an iron-type head comprising a series of walls delimiting an internal cavity, i.e., in particular an impact wall whose periphery is attached at all points to other walls belonging to this series.

BACKGROUND OF THE INVENTION

This method of construction is described by means of a specific embodiment in applicants' FR-A-265641, which possesses the advantage of facilitating the distribution of weight along the periphery and behind the impact face. In conventional fashion, the cavity may be filled with a foam made of an expanded material, in order to improve the sonority of the head and to adjust club balance as a last step. It happens, however, that such constructions prove bothersome for the player by virtue of the interference vibrations generated by the shock of the ball on the impact face. These vibrations, which exist within a frequency range of between 1 and 30 KHz, markedly affect the complex idea, difficult to comprehend, of the feel sensed by the player. In any event, reduced vibrations contribute appreciably to enhanced club feel.

Applicants have been able to measure the phenomenon by virtue of which iron-type clubs made of steel, i.e., those made in one piece, produce naturally a greater damping effect within the frequency range cited. It is, therefore, not surprising to see that professional golfers prefer to play with this type of iron. On the other hand, the distribution of weight can be optimized in similar fashion only in irons termed "hollow," i.e., in those having an internal cavity.

SUMMARY OF THE INVENTION

The present invention is intended to propose an improvement made to irons, by ensuring reduced interference vibrations while retaining the advantages linked to the existence of the cavity allowing distribution of weight and increased moment of inertia of the head in all directions.

Secondarily, the invention is intended to provide distinctions of sound finer than those provided by "hollow" irons incorporating foam in conventional fashion.

To this end, the invention concerns an iron-type club head comprising a hollow metal body incorporating an internal cavity delimited by a series of walls, including an impact wall attached peripherally at all points to other walls, this club head being characterized by the fact that the inner surface of the impact wall is coated with a thin layer of a viscoelastic resin having damping properties. This layer fills only part of the aforementioned internal cavity.

The localized damping means in direct contact with the impact plate make it possible to dissipate the amplitudes of the interference vibrations. The viscoelastic material is stressed under shearing action because, since it is in contact with the impact wall, it follows the vibrations in the wall. Given that its modulus is lower, the deformations of the material are more pronounced than those in the wall.

In one embodiment of the invention, the thickness of the resin layer is, on average, between 1 and 8 mm, and its density, between 1 and 2. Therefore, the weight added to the impact plate is negligible relative to the available weight distributed on the periphery and behind this plate.

According to another configuration, the volume filled by the resin layer does not exceed 50%, and is preferably between 25 and 35%, of the total volume of the internal cavity.

According to a further arrangement, the volume remaining available in the cavity is filled with a foam made of an expanded plastic material having a density of less than 1. The foam ensures, at least in part, that the resin will be held in place against the surface of the impact plate, by filling the remaining space, in which gaps are caused by shrinking of the resin. The foam also makes it possible to adjust the balance of the club, while also enhancing its sonority. In addition, the foam acts as a backing plate resting on the viscoelastic layer, and it allows increase of the rate of shear action within the viscoelastic material.

According to an advantageous arrangement, the edges of the resin layer are lodged, at least in part, in a peripheral groove, whether continuous or not, provided inside the cavity in proximity to the impact wall.

According to a further arrangement, a damping resin is chosen which is usuable by means of low-pressure molding or of gravity, by implementing the reaction injection molding process (RIM).

BRIEF DESCRIPTION OF THE DRAWINGS

Other features and advantages of the invention will emerge from the following description provided with reference to the attached drawings, which are supplied solely by way of example, and in which:

FIG. 4 illustrates the step involving manufacture of the metal body and assembly of the impact wall to the other walls in the body. FIG. 5 illustrates the step involving pouring of the resin layer inside the inner cavity along line C, C';

DESCRIPTION OF THE PREFERRED EMBODIMENT

Figure 1:
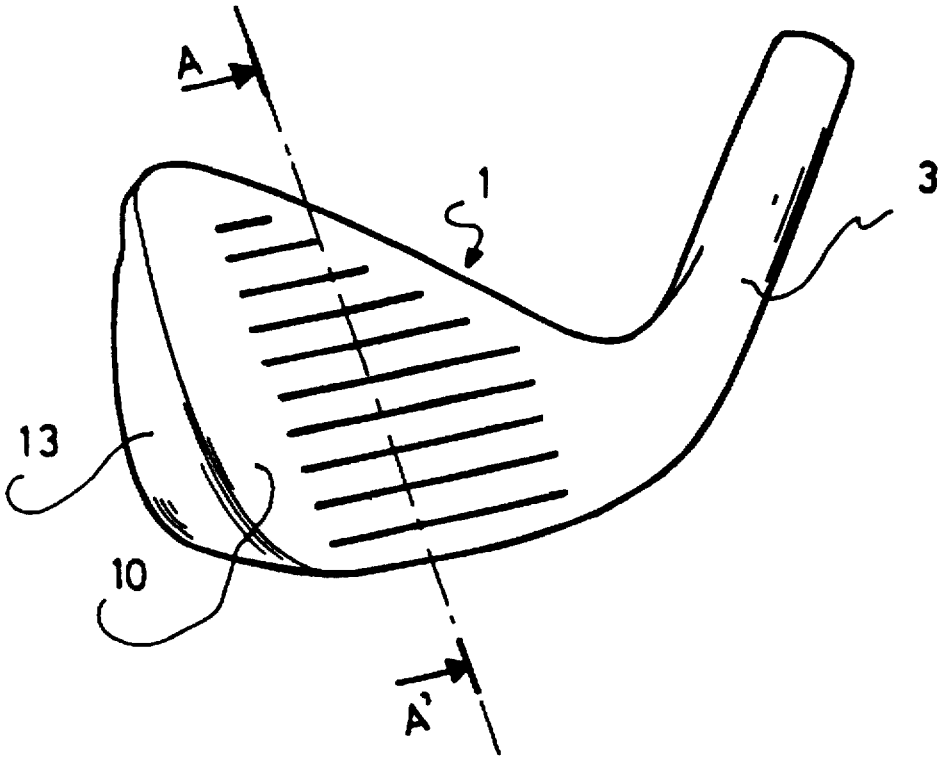
FIG. 1 is a perspective view of an iron-type head according to the invention.
Figure 2:
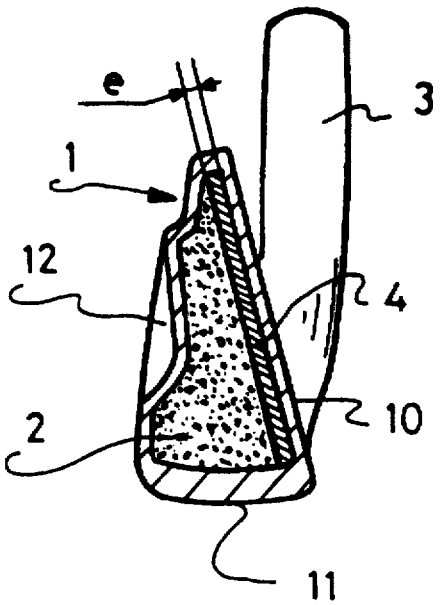
FIG. 2 is a view in cross-section along line A–A' of the head in FIG. 1.
Figure 2A:
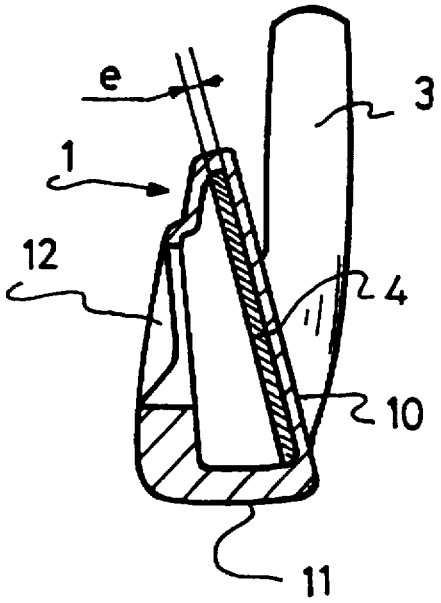
FIG. 2*a* is a view of a variant of FIG. 2.

The iron head according to the invention and illustrated in FIGS. 1, 2 and 2*a* comprises a hollow metal body 1 comprising a front, or impact, wall 10 on which blows are struck. This impact wall 10 is of a thickness sufficient by itself to ensure shock-resistance. When steel is used, the thickness is between approximately 2.5 and 4 mm. The peripheral edges of the impact wall 10 are attached to the other walls 11, 12 and 13 of the body, which extend to the rear of the impact wall. In the illustrated example, the other walls comprise a wall 11 constituting the sole, another wall 12 constituting the rear wall, and a wall 13 constituting the wall forming the toe of the head. On the heel side of the head, the body is extended by a neck 3, which coorperates with a shaft (not shown). The thickness of the walls may vary, thus allowing a determinate distribution of weight.

The body 1 unites these walls 10, 11, 12, 13 into a single, integral piece, in such a way that a sealed or open inner cavity 2 is formed. The body may be made of steel, bronze, titanium, aluminum, cuproberyllium, or other frequently-used alloys. The inner surface 100 of the impact wall 10 is coated with a layer 4 of viscoelastic resin possessing effective damping properties at ambient temperature at vibration frequencies of between 1 and 30 Khz. The thickness e of the layer 4 may range from 1 to 8 mm. The density of the material is approximately 1 to 2, and its hardness is at most 40 Shore D. As an example, the use of PU-type elastomer resins may be mentioned.

The remaining volume of the cavity 2 is advantageously filled with a foam made of an expanded plastic material and having a density of less than 1. The foam presses against the layer 4 while keeping it in place. It acts as a backing plate by increasing the shearing action of the layer 4.

Figure 3:
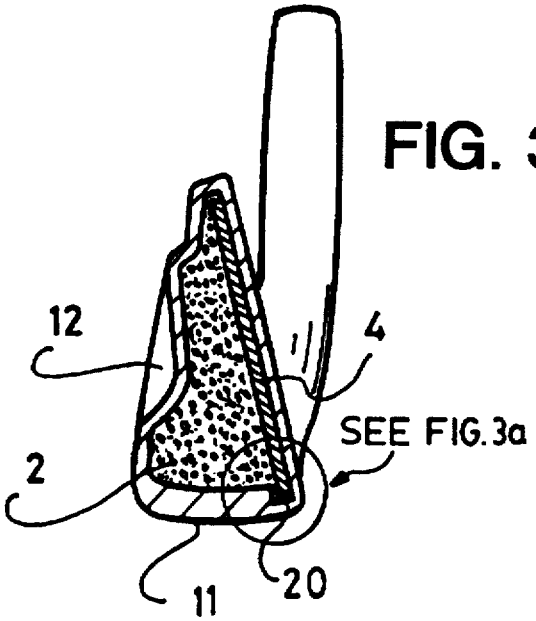
FIG. 3 is a view of a further variant of FIG. 2.
Figure 3A:
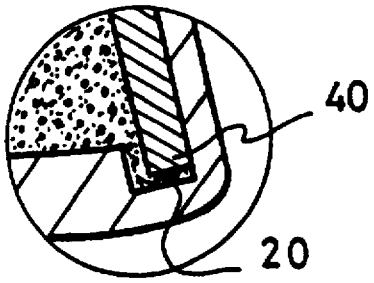
FIG. 3*a* shows a detail of FIG. 3.

FIG. 3 illustrates a variant in which the cavity 2 is fitted with a peripheral groove 20 in which the edges 40 of the resin layer 4 are inserted. The groove may extend continuously over the entire periphery in proximity to the impact plate, or it may be discontinuous, extending only over a portion of the periphery. The foam acts, as a means for holding the plate in place, and it fills the gaps caused by shrinkage of the resin (FIG. 3*a*).

Figure 4:
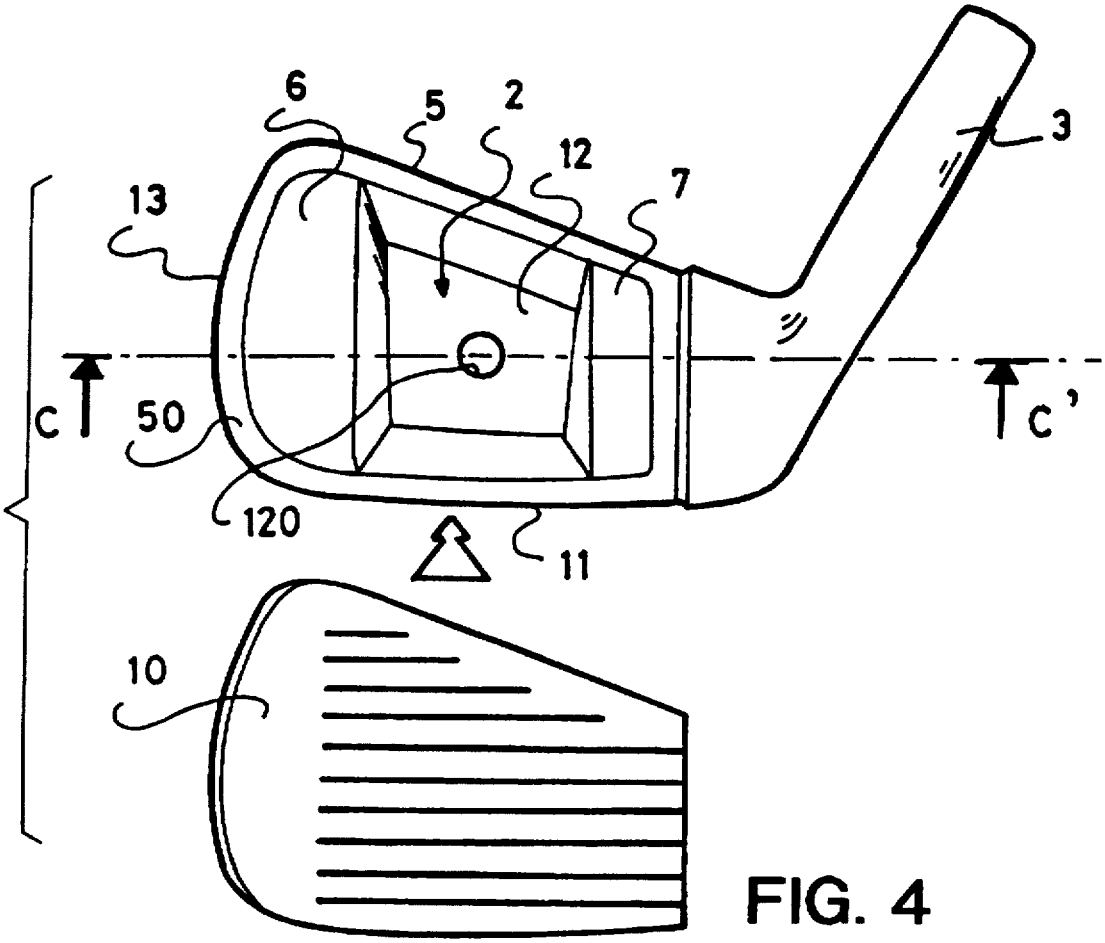
FIGS. 4 and 5 illustrate an example of the process of manufacture of the head according to the invention.
Figure 5:
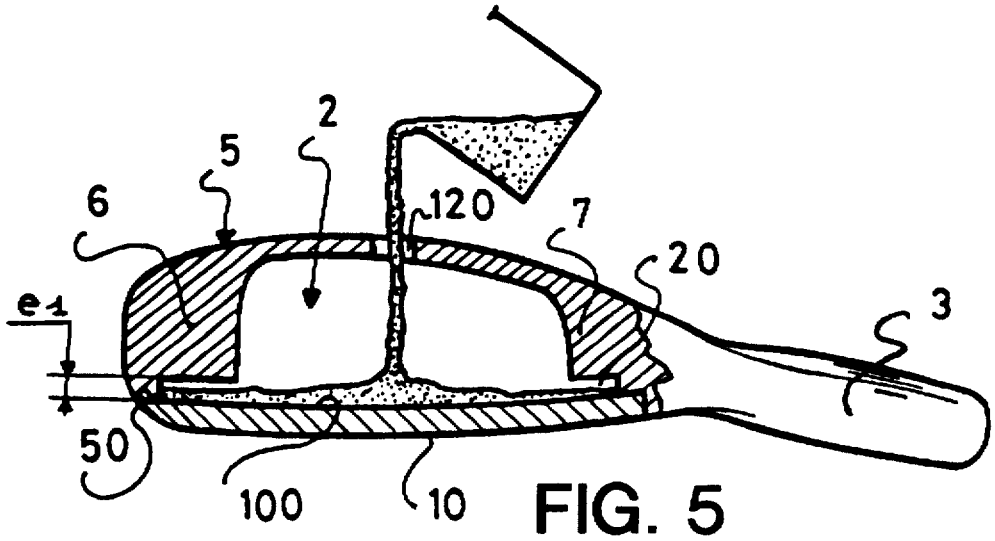

FIGS. 4 and 5 illustrate an example of the process of manufacture of an iron-type head according to the invention.

A first step involves the separate manufacture of the impact wall 10 as a first component, and of the remainder of the body as a second component 5 comprising the other walls 11, 12, 13, which are fastened to the neck 3. The two components are advantageously made of molded steel. The molding method makes it possible to manufacture simply the ballast pieces 6, 7 attached to the walls 11, 12, 13 and forming excess thicknesses extending toward the interior of the cavity 2.

In the example illustrated, the two ballast pieces 6, 7 are spaced apart and positioned, respectively, in the area of the toe and in the area of the heel of the head. This specific distribution, which is conventionally known, makes it possible to increase the lateral inertia of the head, thereby imparting increased tolerance and accuracy when off-center blows are struck. Of course, this distribution is provided only by way of example, and other weight distributions are possible.

A second step of the process consists in assembling and welding the two molded components together. To this end, the main component 5 comprises a peripheral shoulder on which the impact wall 10 is supported. The ballast pieces 6, 7 are separated by a certain distance $e_1$ from the inner surface 100 of the impact wall 10. The space formed between the ballast pieces 6, 7 and the surface acts as a groove 20 used to hold in place the resin layer employed during the following step. FIG. 5 illustrates this step, in which, by pouring under low pressure or by gravity using the RIM process, the resin formed by two components reacting "in situ" and without expansion is added. Prior to the reaction, the resin exists in low-viscosity liquid form. It thus spreads naturally over the surface 100 and forms a layer having a substantially uniform thickness. The material is introduced through a filling orifice 120 in the rear wall 12 and connecting with the inner cavity. During the filling operation and during the entire resin-hardening time, the head is held in a horizontal position.

In another embodiment, the head may be held at a certain inclination to the horizontal, so as to produce a layer having a non-uniform thickness promoting the damping effect in a certain area of the head, e.g., the heel or the toe.

The viscoelastic material may be a thermoplastic material. In this case, the material may be injected in the molten state through the orifice 20. Attachment is carried out after the cavity has cooled.

In all cases, the material used is intended only to dissipate the vibrations generated on the face and certainly does not possess the properties making it possible to strengthen the impact wall, whose strength proves sufficient.

Figure 6:
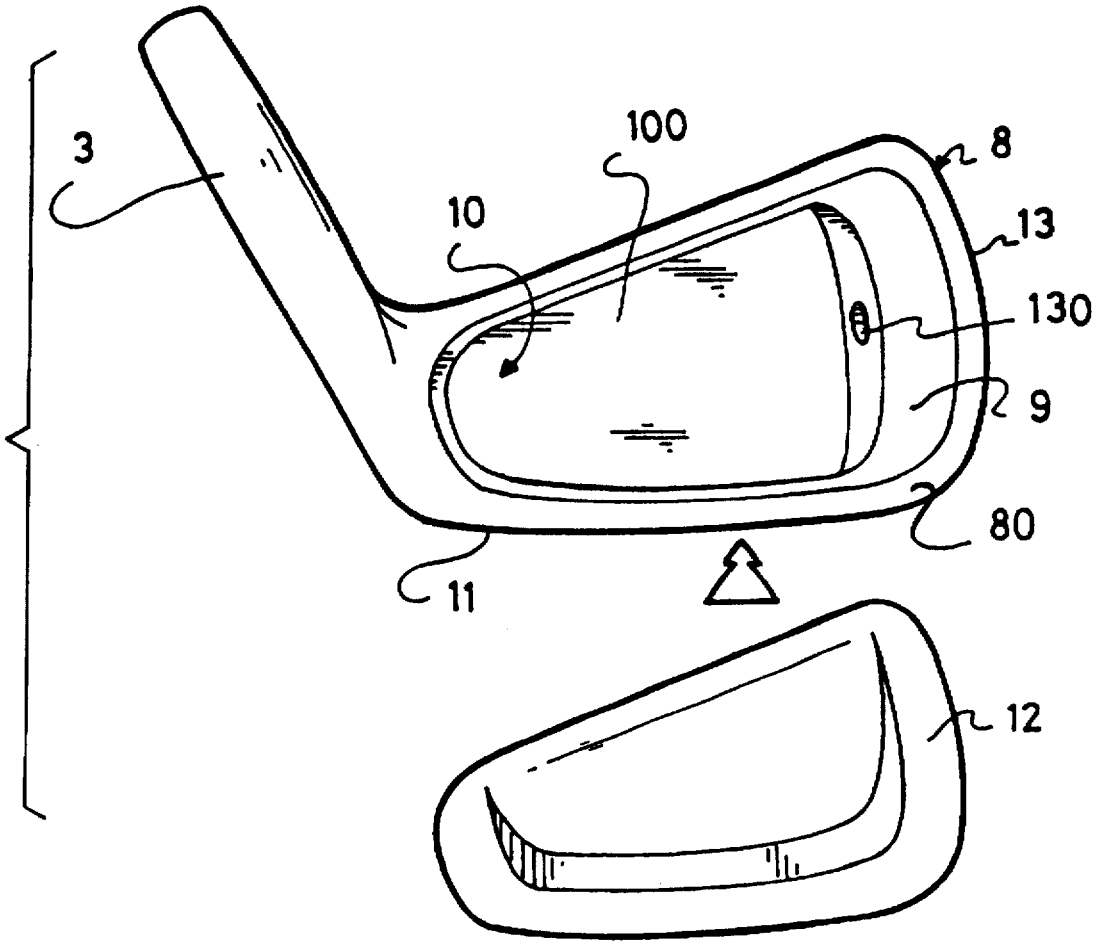
FIGS. 6 and 7 illustrates a variant of FIGS. 4 and 5, showing another type of head assembly.
Figure 7:
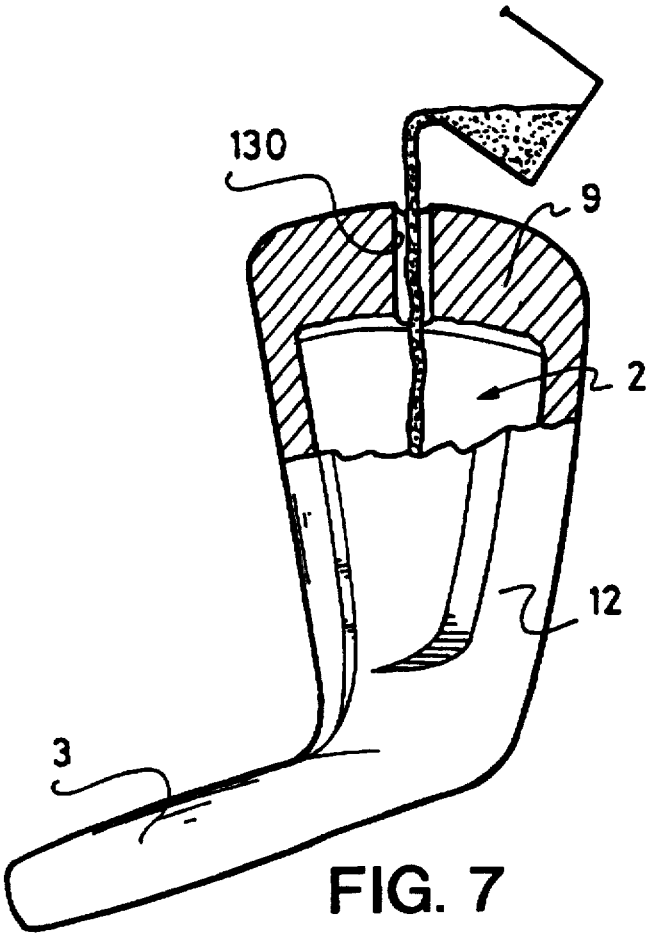

FIGS. 6 and 7 illustrate a second example differing from that of FIGS. 4 and 5, by virtue of a slightly different design.

Here, the first step consists in producing the rear wall 12 separately as a first component, and the rest of the body as a second component 8 comprising the other walls 11, 12 and the impact wall 10 attached to the neck 3. The two components may be molded. The second component advantageously incorporates a principal ballast piece 9 fastened to the wall of the toe 13 and extending as excess thickness toward the interior of the cavity 2.

The second step consists in welding the two components together. The second component 8 may comprise a peripheral shoulder 80 on which the rear wall 12 is supported. Next, the material designed to form the layer of viscoelastic resin is poured through an orifice 130 provided in the lateral wall 13 and connecting with the interior cavity 2. While the resin remains in liquid form, the head is stored in a position in which the face is positioned horizontally until the resin hardens completely.

Other resin layer filling solutions may be provided within the scope of the invention. For example, the neck 3 may incorporate a bore connecting with the inside of the cavity. In that case, filling is effected, for example, by insertion of an injection nozzle into the bore until it reaches the cavity.

A last step common to all of the embodiments described previously (not illustrated) advantageously consists in injecting a filling foam made of a plastic material which expands "in situ," such as a polyurethane foam. The latter is intended to improve the striking sound, to add to position-retention of the resin layer, to act as a backing plate, and, potentially, to further allow adjustment of the balance of the club, in the case in which the shaft/grip unit is mounted on the head. The same filling orifices 120, 130 as those used for the resin may be used. After injection, the orifice is sealed by a plug which may be screwed in, clipped, or adhesively bonded.

Figure 8:
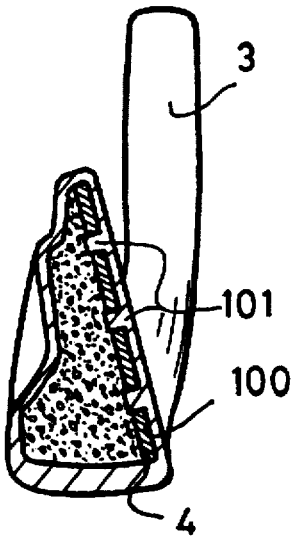
FIG. 8 is a view of a variant similar to that in FIG. 2.

FIG. 8 illustrates an example in which the interior surface 100 is structured and incorporates ribs 101, in order to improve damping capacity by increasing the shear stresses in the material. The ribs also make it possible to improve the solidity of the contact between the resin layer and the internal surface 10 of the impact wall, thereby avoiding risks of detachment affecting club strength.

Figure 8A:
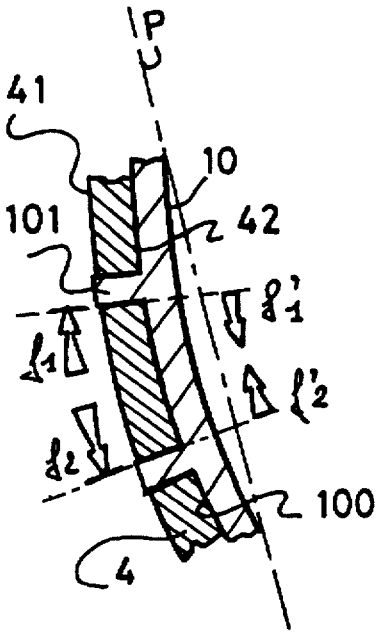
FIG. 8*a* shows a detail of FIG. 8.

FIG. 8*a* illustrates the deformation of the impact wall 10 resulting from the vibratory phenomenon occurring after impact with the ball. When the wall is pushed in toward the interior of the head in relation to the plane of the face (P), the respective forces f1 and f2 generated near the surface 41 on the foam side resist the forces f'1 and f'2 generated near the surface 42 on the wall side 10, thereby generating a sizable shearing effect of the resin layer.

Figure 9:
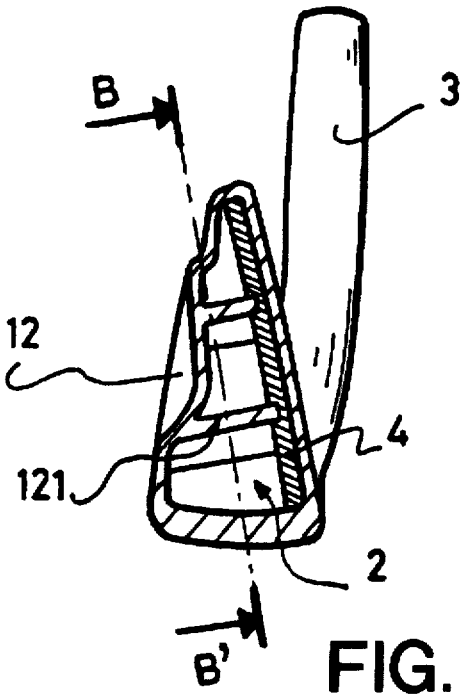
FIG. 9 is a view of a variant similar to FIG. 8.
Figure 10:
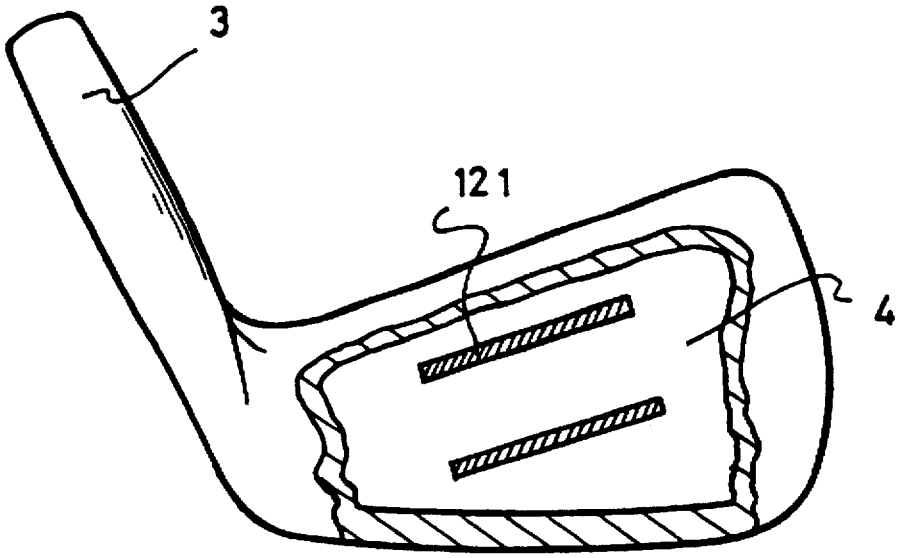
FIG. 10 is a view along line B–B' of FIG. 9.

In the variant shown in FIGS. 9 and 10, the rear wall 12 is fitted with several ribs 121 which project toward the interior of the cavity 2. The ribs extend within one portion of the thickness of the resin layer 4. They are preferably positioned in the central area of the impact wall, where the amplitudes of movement of the viscoelastic material are at a maximum. Their function is to generate additional shearing stresses within the resin layer along the ribs, and thus to increase the damping capacity of the head.

The ribs 101 belonging to the impact wall may also be associated with the ribs 121 belonging to the rear wall of the same head. The ribs 101 of the impact wall may be replaced by any other suitable structure, e.g., a honeycomb.

What is claimed is:

1. An iron-type golf club head comprising a hollow metal body incorporating an internal cavity delimited by a plurality of walls, including an impact wall attached peripherally at all points to other walls, wherein said impact wall has an internal surface coated with a thin layer of a viscoelastic resin having damping properties, said resin layer only partially filling said internal cavity and having a specific gravity between 1 and 2, said layer being adapted for molding under low pressure or by gravity subsequent to formation of said golf club head using a reaction injection molding process (RIM).

2. Iron-type golf club head according to claim 1, wherein said resin layer has a thickness of between 1 and 8 mm.

3. Iron-type golf club head according to claim 2, wherein a volume of said resin layer is a maximum of 50% of a total volume of said internal cavity.

4. Iron-type golf club head according to claim 3, wherein a volume of said internal cavity remaining available is filled with a foam of an expanded plastic material having a specific gravity of less than 1.

5. Iron-type golf club head according to claim 1, wherein said resin layer has edges which are at least partially lodged in a peripheral groove, whether continuous or discontinuous, located inside said internal cavity and in proximity to said impact wall.

6. Iron-type golf club head according to claim 1, wherein said impact wall comprises interior ribs which project toward an interior of said cavity.

7. Iron-type golf club head according to claim 1, wherein said rear wall comprises interior ribs which project toward an interior of said cavity.

* * * * *